US007571562B2

(12) United States Patent
Sutherby

(10) Patent No.: US 7,571,562 B2
(45) Date of Patent: Aug. 11, 2009

(54) ACCESSORY RAIL FOR A RIFLE

(76) Inventor: Kendal E. Sutherby, 11333 Moorpark St., #470, Studio City, CA (US) 91602

( * ) Notice: Subject to any disclaimer, the term of this patent is extended or adjusted under 35 U.S.C. 154(b) by 241 days.

(21) Appl. No.: 11/685,067

(22) Filed: Mar. 12, 2007

(65) Prior Publication Data

US 2008/0005952 A1 Jan. 10, 2008

Related U.S. Application Data

(60) Provisional application No. 60/781,255, filed on Mar. 10, 2006.

(51) Int. Cl.
*F41G 1/38* (2006.01)

(52) U.S. Cl. ..... 42/90; 42/96; 42/85; 42/71.01

(58) Field of Classification Search ..... 42/90, 42/96, 85, 71.01
See application file for complete search history.

(56) References Cited

U.S. PATENT DOCUMENTS

| | | | | |
|---|---|---|---|---|
| 5,198,600 | A * | 3/1993 | E'Nama | 42/90 |
| 6,775,942 | B2 * | 8/2004 | Compton | 42/85 |
| 6,836,990 | B2 * | 1/2005 | Shiloni | 42/96 |
| 6,895,708 | B2 * | 5/2005 | Kim et al. | 42/72 |
| 7,363,741 | B2 * | 4/2008 | DeSomma et al. | 42/85 |
| 2005/0217161 | A1 * | 10/2005 | Haugen et al. | 42/124 |

* cited by examiner

*Primary Examiner*—J. Woodrow Eldred
(74) *Attorney, Agent, or Firm*—Joseph E. Root

(57) ABSTRACT

An accessory rail assembly mountable on a weapon. The rail assembly is formed of first and second mount units, formed to fit around the weapon. The internal profile of the mount units matches the external profile of the weapon in at least one desired location. Also, the mount units have engagement devices arranged to mutually secure the units to one another, thereby exerting force on the weapon stock, such force being limited in direction to a direction parallel to the vertical dimension of the weapon.

10 Claims, 3 Drawing Sheets

ACCESSORY RAIL FOR A RIFLE

PRIORITY INFORMATION

This application claims the benefit of U.S. Provisional Patent Application No. 60/781,255 entitled "Quick-Change Rail for Rifle Accessories" filed on Mar. 10, 2006. That application is incorporated by reference for all purposes.

BACKGROUND OF THE INVENTION

The present invention relates to accessories for small arms, and more particularly to rail systems for mounting accessories on rifles.

The addition of rail systems, led by the revolutionary Picatinny rail system, has radically altered the accessories and equipment typically mounted on a combat rifle. It should be noted at the outset that rail systems are generally applicable to all weapons on which accessories can be usefully mounted. Thus, rail systems can be designed for hunting rifles, shotguns, submachine guns, light machine guns and the like. The illustrations set out below focus on military rifles, as those weapons form the largest group of weapons to which the claimed invention applies, but the invention, as set out in the claims, is not so limited.

Combat rifles in the Vietnam conflict carried practically no accessories. The stock/grip configuration was standard, sights were of the open iron variety, and the only item envisioned as optional equipment was a bayonet, mounted on a stud. Now, however, both day and night optics are expects, along with flashlight illumination, IR or laser illumination/target designator devices, or even devices such as a 40 mm grenade launcher.

All of this optional equipment is made possible by the rail system, which as the name implies, is a multi-purpose mounting platform secured to the weapon. Of course, the rail must be very securely attached, as the optics and the illuminator devices must remain boresighted with the weapon. All conventional systems achieve that stability by providing for some modification of the weapon to accommodate the rail, typically drilling and threading holes to receive mounting screws in either the stock or the receiver.

The requirement to provide such mounting carries several disadvantages. First, the weapon will be limited to one type of rail, as the mounting arrangements differ from rail to rail. Users would prefer to switch rails to arrive at tailored weapon packages for different missions, but that becomes difficult when limited to whatever rail system the weapon has been modified to accept. In addition, such work places an additional burden on combat unit resources, as the joining of rail to weapon typically occurs at the operational level.

It would thus be advantageous to be able to dispense with the weapon modification requirement altogether. The art, however, has not been able to provide such a solution.

SUMMARY OF THE INVENTION

An aspect of the invention is an accessory rail assembly mountable on a weapon. The rail assembly is formed of first and second mount units, formed to fit around the weapon. The internal profile of the mount units matches the external profile of the weapon in at least one desired location. Also, the mount units have engagement devices arranged to mutually secure the units to one another, thereby exerting force on the weapon stock, such force being limited in direction to a direction parallel to the vertical dimension of the weapon.

DETAILED DESCRIPTION

The following detailed description is made with reference to the figures. Preferred embodiments are described to illustrate the present invention, not to limit its scope, which is defined by the claims. Those of ordinary skill in the art will recognize a variety of equivalent variations on the description that follows.

Figure 1:
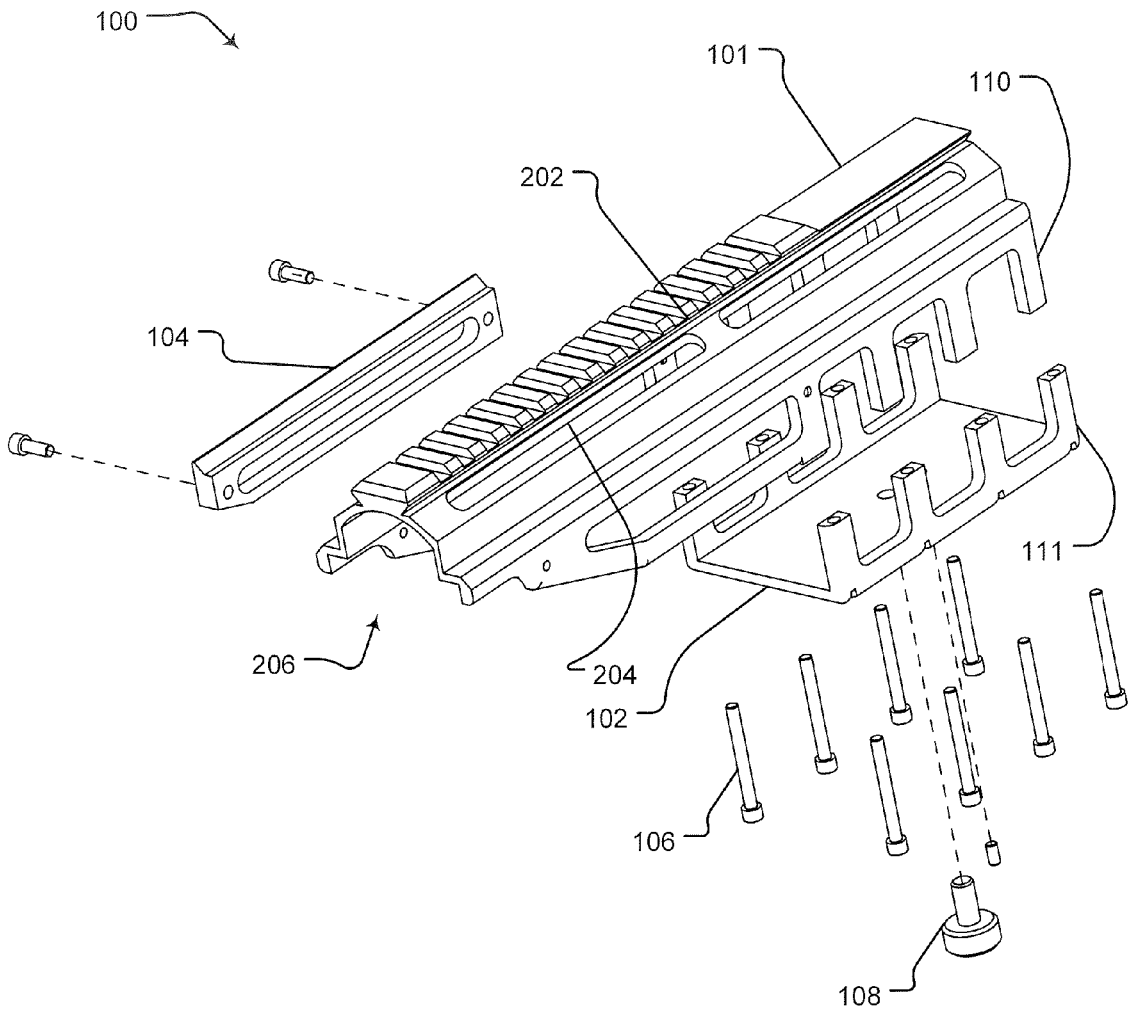
FIG. 1 is an exploded, pictorial view of an embodiment of an accessory rail according to the claimed invention.

FIG. 1 shows an accessory rail 100. As seen, the system includes two primary subassemblies, upper chassis 101 and lower clamp 102. The exterior of both the upper chassis and lower clamp are designed to accept selected accessory mounts. As illustrated, the upper chassis is formed in the configuration of the standard Picatinney rail 202, known in the art. A variety of optics and accessories can be carried on that system, from among the many devices compatible with the Picatinny standard, and the design details of that rail need not be set out further here. Other features as desired can be formed into the top chassis. For example, barrel cooling ports 204 can be provides to promote better air circulation around the barrel in the event of overheating.

Lower clamp 10 can also be adapted for accessories as desired. Here, the clamp carries a tripod adapter 108, which receives the engagement screw of a standard tripod, allowing the weapon to be mounted for firing.

Figure 2:
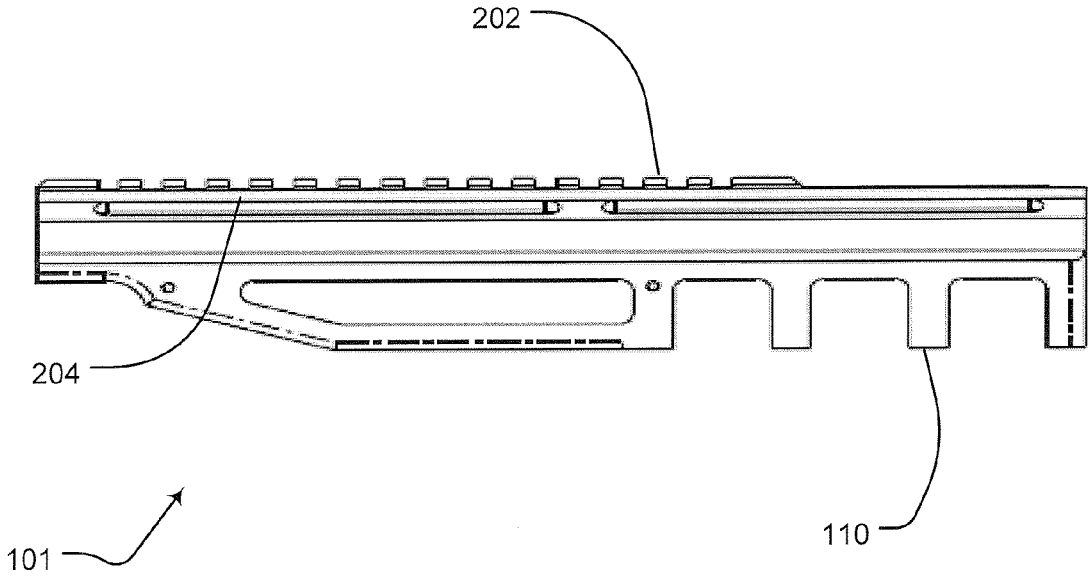
FIG. 2 is a detail side view of the upper portion of the embodiment shown in FIG. 1.
Figure 3:
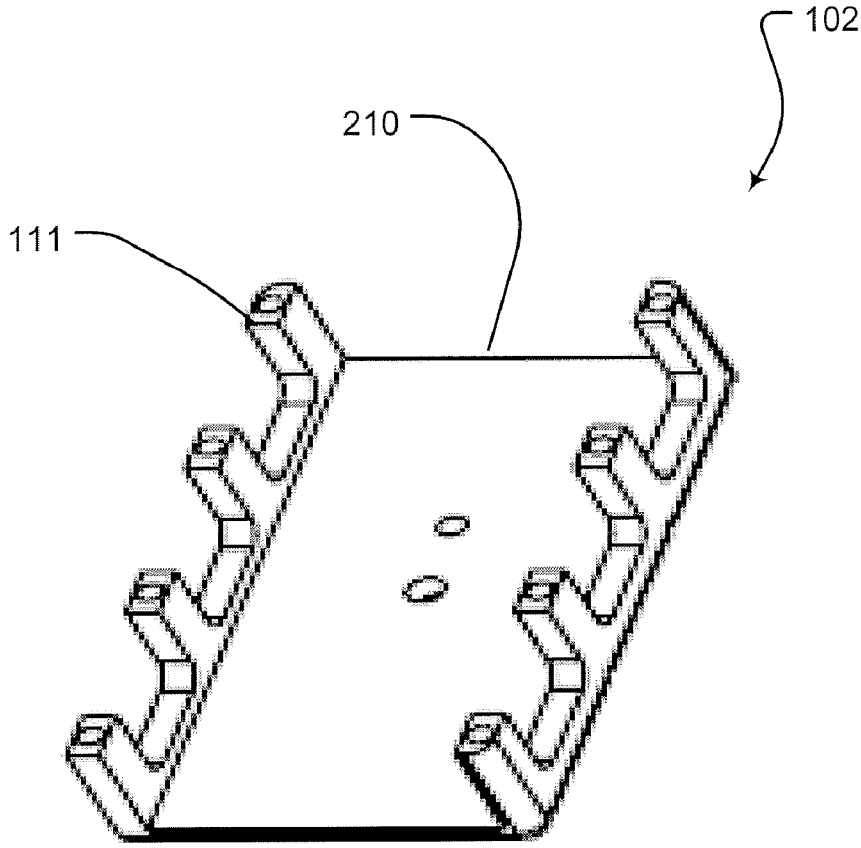
FIG. 3 is a detail pictorial of the lower portion of the embodiment shown in FIG. 1.

The upper chassis and lower clamp fit around the body of a weapon, fitting the upper and lower portions of the same, preferably. Details of both the upper chassis and lower clamp are seen in FIGS. 2 and 3. Upper and lower engagement tabs 110 and 110, respectively, extend toward one another and are adapted to fasten the two portions together. In the illustrated embodiment, fastening is achieved by screws 108. The lower engagement tabs are through-drilled, preferably with appropriate countersinking, to accept the screws, and upper engagement tabs are tapped to accept the threaded ends of the screws. Four engagement tabs are provided on each side, ensuring a secure fit.

A number of alternate fastening methods will suggest themselves to those in the art. In one embodiment the fastening system is a latching system, operated by thumb latches. In another embodiment, a hinge is provided, joining the two elements along one side, and a latch or flip lever is provided on the other side. Various other constructions are possible.

Figure 4:
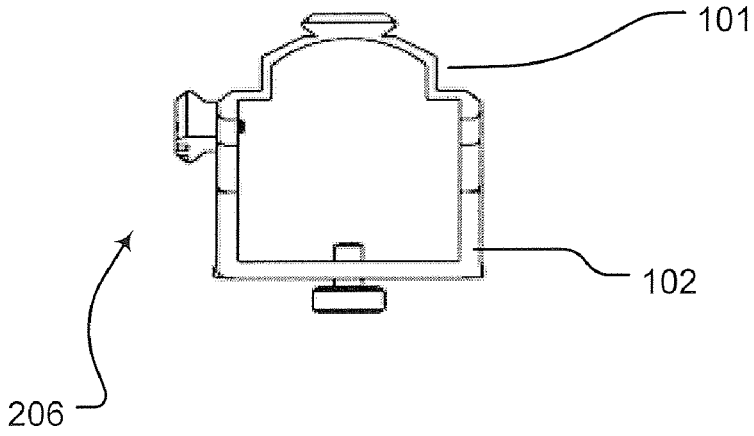
FIG. 4 is a cross sectional view of the assembled embodiment of FIG. 1.

The result can be seen in FIG. 4, a cross-section showing the two assemblies joined. Three points are important about the manner in which the subassemblies fit together. First, the interior 206 of the finished unit is exactly formed to match the exterior of the weapon for which it is designed. There being no attachment point, such as tapped holes in the weapon receiver, the devices of the claimed invention depend on establishing a close fit against the stock of the weapon. That leads to the second point, that the rail interior is designed to make contact only with the weapon stock, not its barrel. This point is important, as placing stress on weapon barrel would introduce an element of inaccuracy to an otherwise highly accurate weapons system. Finally, it has been found desirable that no horizontal stress be applied to the weapon, lest accuracy be affected. Thus, the unit is designed so that the fastening stresses are applied vertically, not horizontally. Here, it is understood that vertically denotes the direction parallel to the plane of the drawing sheet in FIG. 2.

Those in the art will appreciate the necessity for tight manufacturing tolerances, as the fit must be carefully chosen to provide secure gripping of the weapon stock, without applying so much stress that the element itself runs a risk of damage. At the same time, sufficient stress must be applied to provide a steady, reliable firing platform.

Flexibility can be enhanced by adding side rails 104 to one or both sides, as desired. As shown, the side rails are attached by screws, but a number of designs are possible within the skill of those in the art. As illustrated, the side rails conform to the Picatinney standard, permitting the use of illuminating or night vision devices, but any configuration that seems useful for a particular purpose can be employed. Such auxiliary rails can be fastened in place with screws or other suitable fastening devices. Other configurations will be seen as advantageous to those in the art, and such additions or changes fall within the scope of the invention. In one embodiment, an additional rail can be mounted under the bottom clamp, with in another embodiment there are provide multiple Picatinney rails on the upper chassis.

The embodiment shown is machined of aircraft-grade aluminum, with a Class III anodized coating. As to the basic material, other embodiments can employ materials such as stainless steel or titanium. Lightweight, high-strength organic materials could also be used, such as carbon fiber. An embodiment formed from the latter material could be injection molded if desired, giving due consideration to the tolerances required.

As is known in the art, rails offer flexible mounting means, able to be positioned in a number of places and with a number of configurations. All of that flexibility is inherent in the claimed invention, with the added ability to change rapidly among a number of different rail systems. For example, it may be advantageous to have a weapon fitted only with a day optic, with no rail, for light weight. For night operations a first rail could be mounted, designed to accommodate night optics and illumination. That rail could be exchanged for another, adding the ability to mount further accessories under the weapon. All of this is made possible by the ability to dispense with pre-drilled attachment points on the weapon.

These and other embodiments will be apparent to those of skill in the art, all within the scope of the present invention, which is defined solely by the claims appended hereto.

I claim:

1. An accessory rail assembly mountable on a weapon, comprising:

first and second mount units, formed to fit around the weapon, wherein the internal profile of the mount units matches the external profile of the weapon in at least one desired location; and the mount units having engagement devices arranged to mutually secure the units to one another, thereby exerting force on the weapon stock, such force being limited in direction to a direction parallel to the vertical dimension of the weapon.

2. The rail assembly of claim 1, wherein the internal profile of the mount units is formed to make contact with the weapon only on the stock thereof.

3. The rail assembly of claim 1, wherein the external profile of the mount units avoids contact with any day optic or rings thereof mounted on the weapon.

4. The rail assembly of claim 1, wherein the assembly is formed of aluminum.

5. The rail assembly of claim 1, wherein the assembly is formed of titanium.

6. The rail assembly of claim 1, wherein the assembly is formed of stainless steel.

7. The rail assembly of claim 1, wherein the assembly is formed of carbon fiber.

8. The rail assembly of claim 1, wherein the engagement units are screws.

9. The rail assembly of claim 1, wherein the assembly further includes additional mounting rails mountable on a side, or upper or lower surface of the assembly.

10. An accessory rail assembly mountable on a weapon, comprising:

first and second mount units, formed of aluminum to fit around the weapon, wherein the internal profile of the mount units matches the external profile of the weapon in at least one desired location;

the first mount unit has at least one Picatinney standard mount area;

the internal profile of the mount units is formed to make contact with the weapon only on the stock thereof the external profile of the mount units avoids contact with any day optic or rings thereof mounted on the weapon; and the mount units having engagement devices arranged to mutually secure the units to one another, thereby exerting force on the weapon stock, such force being limited in direction to a direction parallel to the vertical dimension of the weapon.

* * * * *